United States Patent [19]

Saito et al.

[11] Patent Number: 4,881,089

[45] Date of Patent: Nov. 14, 1989

[54] THERMAL-ELECTROSTATIC INK JET RECORDING APPARATUS

[75] Inventors: Koichi Saito; Yoshihiko Fujimura; Nanao Inoue, all of Kanagawa, Japan

[73] Assignee: Fuji Xerox Co., Ltd., Tokyo, Japan

[21] Appl. No.: 30,332

[22] Filed: Mar. 26, 1987

[30] Foreign Application Priority Data

Mar. 27, 1986 [JP] Japan ..... 61-67304

[51] Int. Cl.[4] ..... E01D 15/16

[52] U.S. Cl. ..... 346/140 R; 400/126

[58] Field of Search ..... 346/1.1, 140 R, 140 PD; 400/126

[56] References Cited

U.S. PATENT DOCUMENTS 3,790,703 2/1974 Carley ..... 346/1.1
4,383,265 5/1983 Kohashi ..... 346/140 PD

FOREIGN PATENT DOCUMENTS 0090775 5/1985 Japan ..... 346/140 PD
0116451 6/1985 Japan ..... 346/140 PD

*Primary Examiner*—Clifford C. Shaw
*Assistant Examiner*—Huan Tran
*Attorney, Agent, or Firm*—Finnegan, Henderson, Farabow, Garrett and Dunner

[57] ABSTRACT

An ink jet recording head wherein both electric and thermal energies are applied to an ink located in the area to which both energies are applied and employing a plurality of heating resistors for heating the ink, an electric field forming electrode, a heat resistant insulating layer on the surface of the heating resistors and wherein the electric field forming electrode is positioned on the heat resistant insulating layer.

4 Claims, 5 Drawing Sheets

THERMAL-ELECTROSTATIC INK JET RECORDING APPARATUS

FIELD OF THE INVENTION

This invention relates to a non-impact image recording head for recording an image by jetting a liquid coloring agent such as ink at a recording member.

BACKGROUND OF THE INVENTION

The non-impact, or ink jet, recording method is becoming popular as a method for converting image data in the form of electrical signals into hard copies, because less noise is produced during recording than with impact methods.

The ink jet method is considered particularly useful because ordinary paper is usable without need for a special process, such as fixing, for recording purposes as with other recording methods.

The ink jet method that has already been used comprises the steps of filling an airtight container with ink, applying a pressure pulse thereto, and emitting the ink out of the orifice of the container in a jet for recording purposes. The ink jet recorder for the aforesaid method cannot be made compact in view of its operating mechanism, and must be scanned mechanically if recording is to be made with a desired image density. This has caused the recording speed to be reduced.

Other techniques for ink jet recording have been proposed to remedy shortcomings in prior methods and to make high-speed recording possible. For example, a magnetic ink jet method has been prepared which uses magnetic ink in conjunction with a magnetic electrode array. In this method, ink-jet states corresponding to positions of picture elements have been formed by making use of swells of the ink in the presence of a magnetic field, and letting the magnetic ink jet in the presence of a static electric field. This method admits of electronic scanning and, therefore, high-speed recording becomes possible, but it is still disadvantageous in that not only the selection of ink but also coloration characteristic of the ink jet method is difficult.

There is also known the so-called plane ink jet method, which comprises arranging ink in a slitlike inkholder in parallel to an electrode array, and jetting the ink in accordance with an electric field pattern formed between an electrode facing the electrode array through recording paper. Since no minute orifice for storing ink is required in this method, failure due to ink clogging can be prevented. However, high voltage applied for jetting the ink makes it necessary to drive the electrode array on a time division basis to prevent a voltage leak across the adjoining or neighboring electrodes. Consequently, the recording speed cannot be increased to a satisfactory extent.

There has also been proposed the so-called heat bubble jet method for jetting ink out of an orifice by means of thermal energy. In this method, the ink is abruptly heated to cause film boiling and a pressure rise resulting from the rapid formation of bubbles within the orifice is utilized to jet the ink out thereof However, the film boiling temperatures are as high as 500°-600° C. and this makes it difficult to put the aforesaid method to practical use because the ink properties tend to change with heating and because the heating resistor protective layer provided as a heating means is deteriorated at such high temperatures.

As set forth above, there are unsolved problems associated with the ink jet methods heretofore developed, the problems including difficulty in sufficiently increasing recording speed, the necessity of employing special ink and contriving a particular driving means, and thermal deterioration of the ink and the heating means.

OBJECT AND SUMMARY OF THE INVENTION

The present invention is intended to solve the above problems and it is therefore an object of the invention to provide an image recording head for recording images at high speed without difficulty in selecting ink for use.

In accordance with the present invention, an image recording head is provided wherein both electric and thermal energies are applied to a liquid coloring agent arranged therein to jet the liquid coloring agent located in the area to which both the energies have been applied. The image recording head comprises thermal energy applying means for heating the liquid coloring agent and electric energy applying means for applying an electric field to the liquid coloring agent. The thermal energy applying means further comprises a plurality of heating resistors arranged on a base and lead electrodes for supplying current to the heating resistors and a heat resistant insulating layer provided on the surface of the thermal energy applying means. The electric energy applying means comprises an electric field forming electrode installed on the heat resistant insulating layer.

The contour of the electric field forming electrode should preferably be selected so that the area of the portion thereof located immediately above the lead electrode is minimized.

The method of operation of the image recording head according to the present invention comprises applying the electric and thermal energies to the liquid coloring agent and jetting the agent located in the area to which both the energies have been applied.

The aforesaid operation is implemented as follows:

An electric field is uniformly applied to the whole liquid coloring agent first. In this state, the agent is not yet stimulated to be jetted. Thermal energy is then locally applied to the agent, whereby the agent located in the area receiving the thermal energy is caused to be jetted.

A plurality of electric heating elements, for instance, are arranged in the form of an array and allowed to contact a liquid coloring agent. In response to an image signal, a heating element located in a position corresponding to a recording picture element is selectively heated and a uniform electric field is applied to the whole liquid coloring agent. Thus, the liquid coloring agent is caused to be jetted at a recording member. One picture element is recorded by each jetting of the coloring agent such that by repetition of the aforesaid process, a picture element train in the form of a line is recorded. An image can be recorded by scanning the recording member.

The heating resistant insulating layer provided on the surface of the thermal energy applying means is used to prevent the thermal energy applying means from contacting the liquid coloring agent at high temperatures which would cause corrosion of the thermal energy applying means.

The lead electrode for supplying current is connected to each of the heating resistors constituting the thermal energy applying means. The heat resistant insulating layer also functions as an a means for intensifying the insulation between the electrodes.

Moreover, if the electric field forming electrode is formed on the heat resistant insulating layer, production is facilitated, because circuit elements can be concentrated in one of the wall members and electrical connections are also integrated. The area to which thermal energy is applied and the electric field forming electrode are located close to each other to ensure actuation and high-speed operation. Furthermore, the formation of the electric field forming electrode in such a manner as to bypass the portion immediately above the lead electrodes nullifies the effect of capacitive coupling to the lead electrodes. This may be accomplished by forming the electric field forming electrode so that it does not overlap the lead electrodes beneath it.

BRIEF DESCRIPTION OF THE DRAWINGS

The present invention will be better understood by reference to the accompanying drawings wherein.

DETAILED DESCRIPTION OF THE INVENTION

Figure 2A:
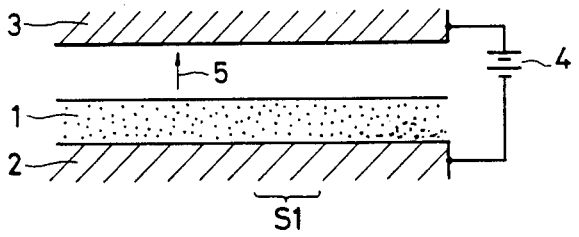
FIGS. 2(A), 2(B) and 2(C) are schematic diagrams illustrating the recording principle according to the present invention.

As shown in FIG. 2(A), a liquid coloring agent 1 is arranged in between a base electrode 2 and an opposite electrode 3. The liquid coloring agent 1, may comprise ink (hereinafter referred to as simply the "ink 1") having suitable electrical resistance and being in a liquid state during operation of the recording head. The base electrode 2 and the opposite one 3 are both conductive plates.

A d.c. power supply 4 is used to apply voltage across the electrodes 2 and 3. A fixed static electric field is applied to the ink 2 and, because of its static inductive action, the Coulomb force given by the sum of the inductive charge produced thereby and the static electric field acts on the free surface of the ink. Therefore, the ink 1 attempts to jet in a direction 5 due to that force.

On the other hand, the surface tension, interfacial tension, and viscosity resistance of the ink act as a drag on the ink. FIG. 2(A) shows the state in which the drag is greater than the Coulomb force and the surface of the ink level remains flat.

Figure 2B:
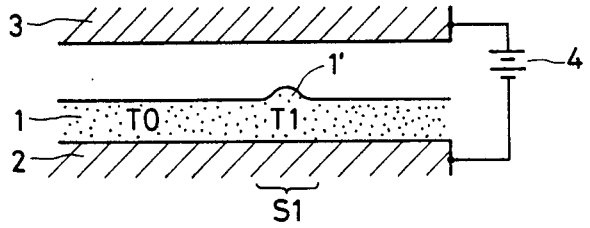
Figure 2C:
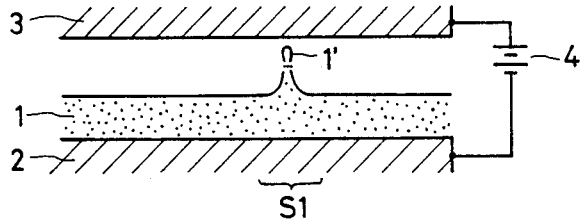

The ink 1 is then locally heated; that is, the temperature of an area S1 in FIG. 2B is raised to a level T1 that is higher than the temperature T0 of the rest of the ink. As shown in FIG. 2(B), the liquid ink level in the area S1 is caused to swell, i.e., there is a reduction in the drag in the area S1 as the ink temperature rises to allow the action of the Coulomb force to dominate. The electric field is concentrated in the ink 1' thus swollen and the action of the Coulomb force is further accelerated. Ultimately, part of the ink 1' in the area S1 takes the form of a column as shown in FIG. 2(C) and a droplet will be jetted to the opposite electrode 3.

The levels of the thermal and electrical energies applied by the electric field and the heating of the ink are so selected as to allow the ink in the area to which both the energies have been applied to jet out. By controlling the applied electrical and thermal energies, the location where the ink is caused to jet and the timing of the jetting can be controlled.

The aforesaid principles are demonstrated by the following experiments.

The ink 1 was arranged on the base electrode 2 as shown in FIG. 2(A) and, while the temperature thereof was kept constant, the voltage of the power supply 4 was gradually raised. When the voltage exceeded a certain level, an ink column 1' as shown in FIG. 2(C) began to grow randomly toward the opposite electrode 3. This phenomenon is explained as the growth of a unstable electrical fluid mechanical wave in "FIELD COUPLED SURFACE WAVES"; pp. 61–66, J. R. Melcher (M. I. T. Press).

In other words, the Coulomb force is locally concentrated by the perturbation (local uneveness in the deformation of the liquid level or electric field) naturally produced when the Coulomb force acting in the upward direction perpendicularly to the ink liquid level occurs when the Coulomb force overcomes the drag to allow the ink column to grow.

In the present invention, the electric field is preferably selected to be insufficient to itself cause an ink column to grow randomly. Instead, the electric field is applied as the ink is heated to reduce the surface tension and viscosity of the ink. As a result, ink columns may be produced in selected locations.

The ink thus caused to jet was led to the surface of a recording member such as recording paper so that one dot could be recorded. Moreover, an image could be recorded by arranging the dots methodically.

Figure 1:
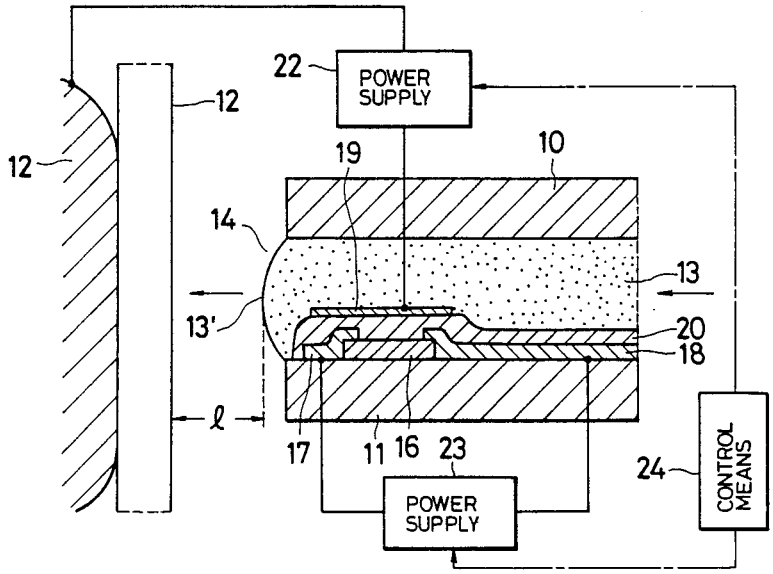
FIG. 1 is a vertical sectional view of an image recording head embodying the present invention.

FIG. 1 is a transverse sectional view of an image recording head and its peripheral portion embodying the present invention.

As shown in FIG. 1, a pair of wall members 10, 11 are arranged so that one edge of each faces a recording member 12. The recording member 12 is a sheet of ordinary recording paper, of the type, for example, used in a conventional copying machine.

The pair of wall members 10, 11 are arranged a fixed space apart and a liquid coloring agent 13 is provided therebetween. The edges of the wall members 10, 11 set opposite to the recording member 12 form a slit having a width in the direction perpendicular to the paper surface. The slit portion is called a discharge opening 14 and the liquid coloring agent 13 forms a convex face 13' at the discharge opening because of its surface tension.

A plurality of heating resistors 16 are installed on the inner face of one wall member 11, the heating resistors being spaced apart and arranged in an array to extend perpendicularly to the paper surface. An electrode 17 common to the heating resistors 16 is connected to one end of each of the resistors and lead electrodes 18 are connected to the opposite ends thereof. A heat-resistant insulating layer 20 covers the heating resistors 16 and the electrodes 17 and 18.

An electric-field forming electrode 19 is formed on the surface of the heat-resistant insulating layer 20.

Figure 3:
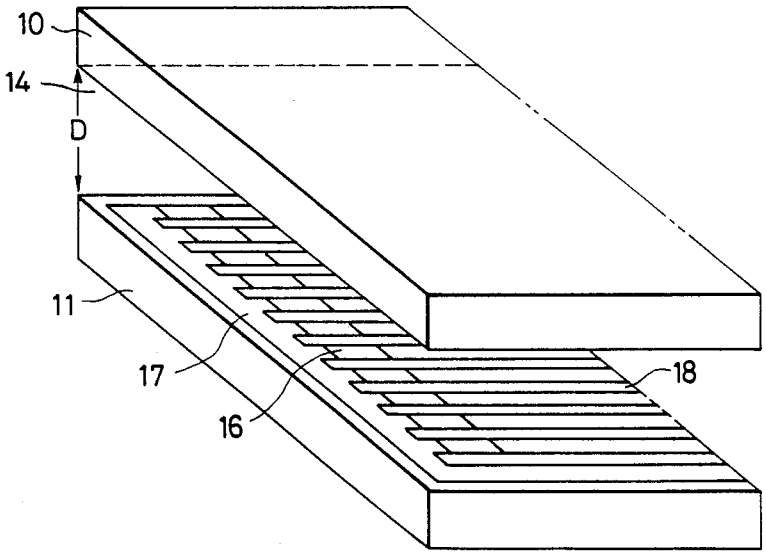
FIG. 3 is a perspective view of a principal portion thereof the recording head of FIG. 1.

FIG. 3 is a perspective view of the principal portion of the recording head of FIG. 1.

The array of heating resistors 16 set are preferably constructed in the same manner as in the thermal head. The so-called edge type thermal head is employed in this example to record with a density of 8 dots/mm on thermal recording paper having a color development temperature of about 90° C. When a recording is made on the thermal recording paper, power of 0.5 W/dot is supplied to each heating resistor for 1 msec. The space D selected between the pair of wall members 10, 11 may be set at 100 μm.

As further shown in FIG. 1, the gap 1 between the discharge opening 14 and the recording member 12 may be set at 200 μm, and the gap between the discharge opening 14 and the end of the heating resistors may also be set at 200 μm.

Further, an opposite electrode 21 is provided to support the rear face of the recording member 12 and a power supply 22 applies a fixed voltage across the recording gap. The electric-field forming electrode 19 may be grounded and +1,500 V may be applied to the opposite electrode 21, whereby an electric energy applying means may be constructed.

Moreover, a power supply 23 may be connected to both the electrodes 17, 18 on both sides of the heating resistors 16, to embody the thermal energy applying means.

A control means 24 is connected to the power supplies 22, 23 so that the electric energy may be switched on and off, in response to the image signal of an image being recorded. The control means 24 may be formed as a circuit constituted by a shift register driver for driving known thermal heads and the like.

As the liquid coloring agent 13 in this example, the ink used for the purpose contained about 15% by weight of carbon-black pigment dispersed in liquid paraffin, with volume resistivity at 20° C. being $1.0\times10^{6}\Omega\cdot$cm, viscosity at 300 cp, and surface tension at 70 dyne/cm.

When the voltage derived from the power source 22 was applied across the electric field forming electrode 19 and the opposite electrode 21 in the recording head thus constructed, the liquid coloring agent located close to the discharge opening 14 was subjected to a uniform electric field.

Current, e.g., 25 mA at 25 V, was selectively supplied to the heating resistors 16 for 1 msec in the aforesaid state.

Only the ink 13 located close to the heating resistor 16 and supplied with the current was jetted at the recording member 12 and a circular dot about 150 μm in diameter was recorded on the recording surface. Recording was sensible even though the length of time required for supplying power was shortened up to 200 usec.

When the above operation was conducted with no voltage applied across the electric field forming electrode 19 and the electrode 21, ink was not caused to jet at the recording member. When the voltage applied across the electric-field forming electrode 19 and the opposite electrode 21 was raised without supplying the current to the heating resistor 16, the ink 13 was seen to jet randomly throughout the discharge opening 14 at a voltage level exceeding 3,000 V.

Since the ink is caused to jet by applying at the same time the electric and thermal energies to the liquid coloring agent, there must be clearly defined the conditions under which it is allowed to jet and a marginal value (threshold value) at which control can be effected to ensure stable ink jetting. FIGS. 4(A) to 4(D) are graphs showing the results of experiments intended to identify the threshold values.

Figure 4A:
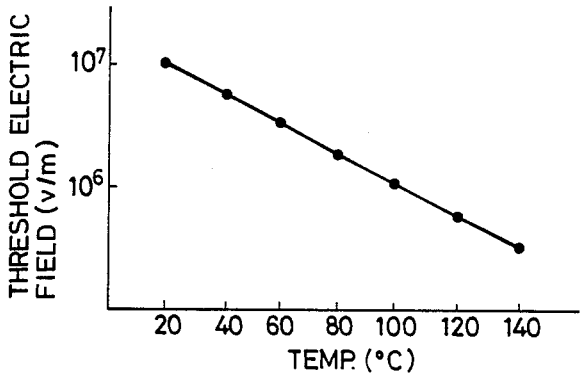
FIGS. 4(A), 4(B), 4(C), and 4(D) are graphs showing the dependence of the threshold value of an electric field on temperatures and other properties of ink.

According to the data shown in FIG. 4(A), the relationship between the ink temperature, and the threshold electric field value is substantially linear.

Figure 4B:
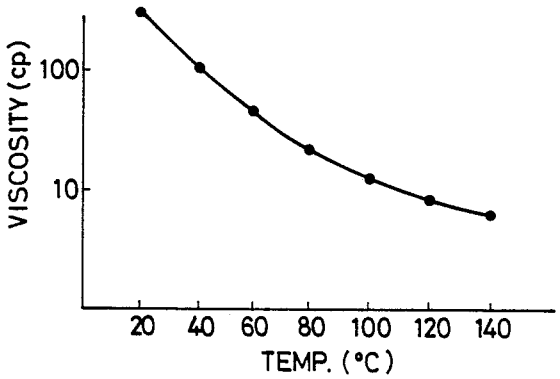
Figure 4C:
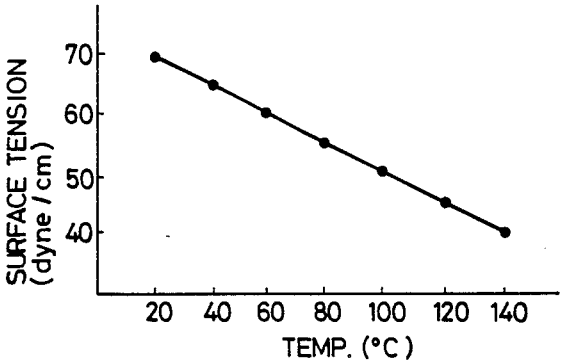
Figure 4D:
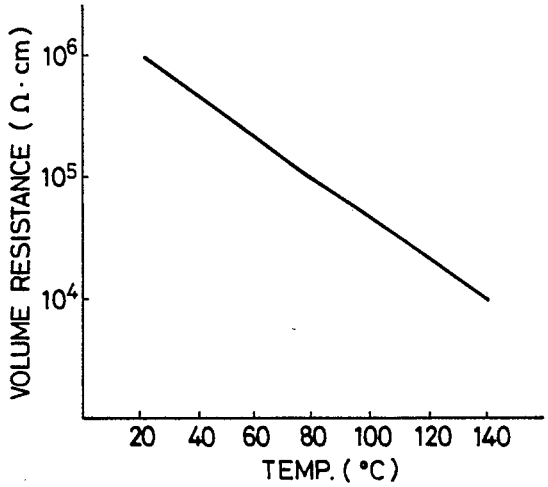

As shown in FIG. 4(B), on the other hand, the relationship between viscosity of the ink and the ink temperature is not similarly linear although the viscosity decreases and the ink temperature rises. The relationship between ink temperature and surface tension and specific volume resistance are shown in FIGS. 4(C) and 4(D) respectively.

In other words, the threshold electric field value decreases as the temperature rises, depending on the combined effects of changes in the physical properties of the ink including the viscosity, surface tension and electrical conductivity. Thus, even though at a specified electric field ink at room temperature will not be jetted, the ink will jet in the presence of the same electric field when it is locally heated because of the cooperative action of the heat and static electric field, so that picture element recording is carried out.

If the electric field forming electrode is formed immediately above the heating resistors as aforementioned, static induction is caused in a position where the temperature contrast, i.e., rise, of the ink is maximized. That is, the maximum effect of the electric field will occur in the area where the ink temperature is maximized.

In other words, the specific volume resistance of the ink decreases as the ink is heated and the electric field is concentrated in the area of the heated portion of the ink. Therefore, the difference in the concentration of the electric field between the aforementioned heated area of the ink and the remaining ink becomes greater, and greater control may be exercised on ink jetting.

For the image recording head according to the present invention, an electric field electrode was formed of gold 1000 Å thick. The selected gap between the edge on the discharge portion side of the heating resistor 16 and the discharge portion 14 was set at 50 μm–600μm. For the comparative image recording head, an electric field forming electrode was formed underneath the upper wall member 10 of FIG. 1. The material qualities, dimensions, and edge positions were not changed. The application of voltage by a power supply 22 and the supply of current to heating resistors 16 were arranged at the same timing and for the same length of time to make recording. As a result, the image recording head according to the present invention started recording 260 μsec later, whereas the comparative image recording head required the application time for more than 4 msec. Obviously, the image recording head according to the present invention was capable of recoriing with extremely small energy.

Figure 5:
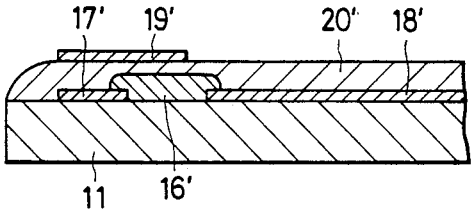
FIG. 5 is a vertical sectional view of an modified example of the image recording head embodying the present invention.

FIG. 5 shows an example of a modified principal portion of a recording head for an image recorder embodying the present invention. As in the case of FIG. 1, heating resistors 16' arranged in an array on a wall member 11. In this example, a common electrode 17' and lead electrodes 18' connected to the heating resistors 16' and are formed underneath the heating resistors 16'. A heat resistant insulating layer 20' is formed on the surface of each heating resistor 16' and an electric field forming electrode 19' is formed thereon.

The electric field forming electrode 19' is formed in such a manner as to bypass a portion directly above the lead electrode 18', so that there is no overlap above the lead electrode 18'. A driving diode matrix (not shown) for selectively supplying an electric pulse to the lead electrode 17' is normally connected thereto. In this case, the lead electrode 18' for applying the electric pulse is grounded through the heating resistor 16' and the common electrode 17'. However, since the other lead electrodes are not grounded, greater capacitive coupling is produced between the lead electrode 18' and the electric field forming electrode 19'. Accordingly, a large reactive current is supplied when current is supplied to the selected heating resistor. This means a voltage drop is caused in the power supply circuit, so that the desired power cannot be supplied to the heating resistor 16'.

As shown in FIG. 5, the electric field forming electrode 19' is formed in such a manner as to bypass the portion right above the lead electrode 18'. At this time, however, if both the common electrode 17' and the electric field forming electrode 19' are grounded, the dielectric breakdown of the heat resistant insulating layer 20' held therebetween can be avoided.

Figure 6:
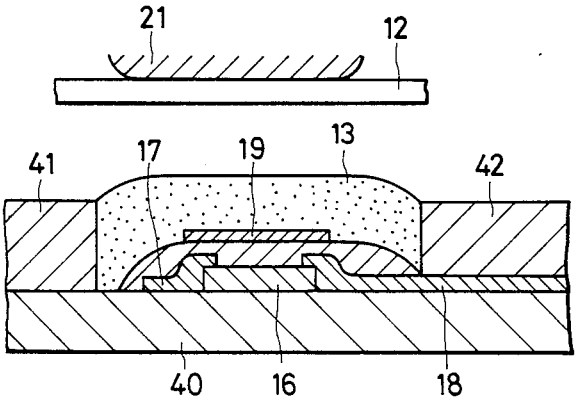
FIG. 6 is a vertical sectional view of still another embodiment of the present invention.

FIG. 6 shows another example of a principal portion of a recording head for an image recorder embodying the present invention. In this example, heating resistors 16 are arranged in an array on a horizontal base 40 as in the case of FIG. 1. Ink 13 is held by damlike members 41, 42 provided on the left and right above the heating resistor 16. On the surface of each heating resistor 16 is arranged a heat resistant layer 20 and an electric field forming electrode 19.

A recording member 12 is arranged above the ink 13 with its recording side down. Moreover, a power supply (not shown) is connected between an opposite electrode 21 and the electric field forming electrode 19, so that an electric field is formed in the direction perpendicular to the base 40.

In the recording head thus constructed, when current is supplied to the heating resistor 16 for heating, the ink 13 is caused to vertically jet at the recording member 12 according to the same principle as aforementioned for recording purposes. The present invention can be implemented with this construction.

From the foregoing description it may be seen that the image recording head according to the present invention is capable of jetting the ink for high-speed and high-density recording at temperatures not exceeding what causes the extreme thermal deterioration of the ink, heating resistors, and the like, and in an electric field that is not so intense as to cause leakage across the electrodes. Moreover, the means for holding the ink is relatively simple in construction and needs no complicated precise mechanism. Furthermore, the required levels of the electric and thermal energies are small so that the driving circuit may be made compact.

Additionally, the heat resistant insulating layer provided on the thermal energy applying means prevents the thermal energy applying means from contacting the liquid coloring agent at high temperatures and thus suffer corrosion.

The lead electrodes for supplying current are connected to the plurality of heating resistors constituting the thermal energy applying means, whereas the heat resistant layer also functions as a means for increasing the insulation between the electrodes.

If the electric field forming electrode is formed on the heat resistant insulating layer, circuit elements are concentrated in one of the wall members and electrical connections can be integrated to facilitate production.

In addition, since the location at which the thermal energy is applied and the electric field is applied are located close to each other, the certainty of actuation and operation can be increased.

If the electric field forming electrode is formed in such a manner as to bypass the portion directly above the lead electrode, it nullifies the effect of the capacitive coupling between the electric field forming electrode and the lead electrode.

While specific embodiments of the present invention have been described, it is recognized that variations thereof may be made.

What is claimed is:

1. An image recording apparatus adapted to apply both electric and thermal energy to a liquid coloring agent to jet droplets of the liquid coloring agent toward a backing electrode adapated to support a recording medium, said apparatus comprising:

container means for containing said liquid coloring agent, said container means comprising a pair of spaced apart, opposing wall members, each of said wall members including an inner surface and at least one edge, said container including a discharge portion at one of said edges of said wall members for discharging said liquid coloring agent from said container means;

a thermal energy applying means for selectively locally heating the liquid coloring agent, said thermal energy applying means comprising a plurality of heating elements arranged on the inner surface of a first one of said wall members and lead electrodes adapted to supply current to said heating elements;

a heat resistant insulating layer being provided over said heating elements;

electric energy applying means for applying an electric field to said liquid coloring agent, said electric energy applying means further comprising an electric field forming electrode positioned on the heat resistant insulating layer;

a first power supply for establishing a voltage drop between the electric field forming electrode and the backing electrode to produce the electric field, said electric field having a level less than the level required to jet liquid coloring agent toward the backing electrode; and second power supply means for selectively energizing said heating elements to raise the temperature of the liquid coloring agent in the area of said energized heating elements to jet droplets of said liquid coloring agent under the influence of said electric field.

2. The image recording apparatus of claim 1, wherein said electric field forming electrode is formed so as to minimize the area thereof located immediately above the lead electrodes.

3. The image recording apparatus of claim 1, wherein said electric field forming electrode does not overlap said lead electrodes.

4. The image recording apparatus of claim 1, wherein said heating resistors comprises an array of elongated resistive elements, the elongated dimension of said resistive elements extending in the direction of the jetting of the liquid coloring agent.

* * * * *

UNITED STATES PATENT AND TRADEMARK OFFICE

CERTIFICATE OF CORRECTION

PATENT NO. : 4,881,089

DATED : November 14, 1989

INVENTOR(S) : Koichi Saito et al.

It is certified that error appears in the above-identified patent and that said Letters Patent is hereby corrected as shown below:

Claim 1, column 8, and line 29 delete "a"

In figure 1 change "12~" (on the left) to --21~--.

Signed and Sealed this

Second Day of March, 1993

*Attest:*

STEPHEN G. KUNIN

*Attesting Officer*

*Acting Commissioner of Patents and Trademarks*